US009252468B1

(12) United States Patent
Rosas et al.

(10) Patent No.: US 9,252,468 B1
(45) Date of Patent: Feb. 2, 2016

(54) MICROWAVE SIGNAL CONNECTOR

(71) Applicant: Signal Microwave, LLC, Chandler, AZ (US)

(72) Inventors: William Rosas, Chandler, AZ (US); Eric Gebhard, Chandler, AZ (US)

(73) Assignee: Signal Microwave, LLC, Chandler, AZ (US)

( * ) Notice: Subject to any disclaimer, the term of this patent is extended or adjusted under 35 U.S.C. 154(b) by 259 days.

(21) Appl. No.: 13/891,941

(22) Filed: May 10, 2013

(51) Int. Cl.
*H01P 1/04* (2006.01)
*H01P 5/00* (2006.01)
*H01P 11/00* (2006.01)

(52) U.S. Cl.
CPC *H01P 1/04* (2013.01); *H01P 1/045* (2013.01); *H01P 5/00* (2013.01); *H01P 11/00* (2013.01)

(58) Field of Classification Search
CPC ..... H01R 4/00; H01R 4/04; H01R 9/00; H01R 2201/00; H01P 1/042; H01P 1/045; H01P 5/00; H01P 1/04; H01P 11/00
USPC ..... 333/254, 260; 439/578
See application file for complete search history.

(56) References Cited

U.S. PATENT DOCUMENTS

| | | | | |
|---|---|---|---|---|
| 4,540,231 | A | | 9/1985 | Forney, Jr. |
| 4,810,981 | A | * | 3/1989 | Herstein ..... 333/27 |
| 5,402,088 | A | | 3/1995 | Pierro et al. |
| 5,510,405 | A | | 4/1996 | Heucher et al. |
| 5,846,355 | A | | 12/1998 | Spencer et al. |
| 6,621,386 | B2 | | 9/2003 | Drackner et al. |
| 6,784,369 | B2 | | 8/2004 | Song et al. |
| 7,331,820 | B2 | | 2/2008 | Burris et al. |
| 7,828,596 | B2 | | 11/2010 | Malak |

* cited by examiner

*Primary Examiner* — Benny Lee
*Assistant Examiner* — Albens Dieujuste
(74) *Attorney, Agent, or Firm* — Booth Udall Fuller, PLC

(57) ABSTRACT

A microwave signal connector can comprise a first portion of an inner conductor comprising a first diameter. A second portion of the inner conductor comprises a second diameter less than the first diameter and is in contact with the first portion of the inner conductor. An outer conductor is disposed around the first portion of the inner conductor and the second portion of the inner conductor with a first inner diameter disposed over the first diameter and a second inner diameter disposed over the second diameter. A dielectric material is disposed between the second portion of the inner conductor and the outer conductor that extends along a length of the second portion of the inner conductor. An adhesive is attached to the dielectric material, the second portion of the inner conductor, and the outer conductor.

19 Claims, 5 Drawing Sheets

MICROWAVE SIGNAL CONNECTOR

TECHNICAL FIELD

Embodiments of the present disclosure relate to the field of microwave signal transmission.

BACKGROUND

Microwaves are a form of radio waves generally considered to include wavelengths ranging from approximately 1 millimeter (mm) to 1 meter (m) in length. Microwaves are generally considered to include electromagnetic energy ranging in frequency between 300 megahertz (MHz) and 300 gigahertz (GHz). Commonly, microwave applications utilize electromagnetic energy ranging from approximately 1 GHz to approximately 94 or 110 GHz. More commonly, microwave applications utilize electromagnetic energy ranging from approximately 1 GHz to approximately 67 GHz; however, in microwave applications can also use other ranges of electromagnetic energy.

Microwaves are used in the fields of communication, satellites, radar, radio astronomy, navigation, heating and power applications, and spectroscopy. More specifically, microwaves are used extensively in telecommunications for non-broadcast, point-to-point uses. Microwaves are especially suitable for point-to-point uses because microwaves are more easily focused into narrow beams and require smaller antenna sizes than lower frequency radio waves and provide for broad bandwidth and high data flow. Additionally, microwaves are commonly used for transmitting data for television and telephones both between ground stations and between satellites.

Microwaves are also transmitted or propagate through transmission lines. Exemplary transmission lines include single conductor transmission lines such as rectangular waveguides or multiple conductor transmission lines such as microstrips, strip lines on printed circuit boards, and coaxial (or "coax") cables and connectors. Coaxial connectors include an inner conductor surrounded by a tubular insulating or dielectric layer. The inner conductor and insulating layer are surrounded by a tubular outer conductor or shielding layer such that the inner conductor and outer conductor share a geometric axis along a length of the transmission line. Coaxial connectors can optionally include an outer insulating jacket or sheath.

Coaxial connectors generally include circular cross-sectional areas (taken transverse to the axis of the inner and outer conductors), but can also include cross-sectional areas of any shape. Tolerance for dimensions of coaxial connectors are precisely controlled to maintain constant spacing between the inner and outer conductors. Constant spacing between the inner and outer conductors is important because in an ideal coaxial connector a signal carrying electromagnetic field exists only in the space between the inner conductor and the outer conductor. Carrying the signal in the space between the inner and outer conductors of the coaxial connector allows the signal to be shielded or protected from external electromagnetic interference by the outer conductor.

Additionally, an electric field interaction in the coaxial connector caused by propagation of the signal creates a distributed capacitance (C) between the inner and outer conductors. The capacitance is influenced by a number of factors, including a proximity of the inner and outer conductors, relative surface areas of the inner and outer conductors, and a dielectric constant of the material disposed between the inner and outer conductors. Similarly, a magnetic field interaction in the coaxial connector caused by propagation of the signal creates a distributed inductance (L) between the inner and outer conductors. The inductance is influenced by a number of factors, including the proximity of the inner and outer conductors, the relative surface areas of the inner and outer conductors, and the dielectric constant of the material disposed between the inner and outer conductors. An impedance (Z) of the signal line is a function of both the capacitance and inductance. Stated more precisely, the impedance of the line signal is equal to a square root of the inductance divided by the capacitance: $Z=\sqrt{L}/C$. The relationship between the impedance, inductance, and capacitance of a microwave line signal creates a number of challenges for the design of microwave connectors.

One challenge presented by the use of coaxial connectors in systems including microwave line signals is controlling and minimizing reflections of the microwave signal caused by the connectors. Reflections caused within microwave signal connectors can result in part from transmission lines of different diameters being connected to the microwave signal connectors. Systems including more than one size of transmission cables or devices to be connected are not uncommon. Because microwave signal connectors include ends that physically and electrically match the cables or devices being connected, microwave signal connectors also include different diameters, as needed, to satisfy system needs. When a first end of a microwave signal connector includes a first size different from a second size of a second end of a microwave signal connector, a transition between the first and second sizes occurs within the microwave signal connector.

In accounting for the transition between the size of the first and second ends, microwave signal connectors are constructed such that an impedance of the microwave signal connector is constant at the first and second ends of the microwave signal connector. However, because impedance of the signal line is related to a capacitance and inductance of the signal line by the relationship of $Z=\sqrt{L}/C$, the capacitance and inductance associated with each of the first and second sizes of the first and second ends of the microwave signal connector change and are not equal even when impedance through the microwave signal connector is kept the same. The variation or change of the inductance and especially the variation or change of capacitance in a microwave signal connector cause portions of the microwave signal propagating through the microwave signal to be reflected. Reflections of portions of the microwave signal are undesirable because the reflections degrade or weaken a strength of the signal being transmitted. Therefore, compensation steps are used to minimize reflections of the microwave signals being transmitted through microwave signal connectors.

FIG. 1 is a diagram of an exemplary microwave signal connector 10 as known in the prior art. FIG. 1 illustrates details relating to a number of performance related details without disclosing mechanical engagement of the various features. Microwave signal connector 10 includes a connector portion 10*a* and a transition portion 10*b*. Microwave signal connector 10 includes a first end 12 configured to be attached to a transmission line such as a coaxial cable, and a second end 14 configured to be attached to a transmission line such as microstrip 16. Microstrip 16 includes a conductive material or waveguide 18 formed at or on a substrate 20. Microwave signal connector 10 is optionally secured to microstrip 16 with securing portion 22. While microwave signal connector 10 is shown with first end 12 configured to be attached to a coaxial cable and second end 14 configured to be attached to microstrip 16, the microwave signal connector can likewise be configured with first and second ends that are configured to be attached to other transmission lines or coaxial cables of different sizes.

Microwave signal connector 10 includes an inner conductor 26 that extends from first end 12 to second end 14 of the microwave signal connector 10. Inner conductor 26 is bisected by central axis 28 of microwave signal connector 10 and includes a first diameter d1 that extends from first end 12 partially but not completely through the microwave signal connector. The diameter of inner conductor 26 decreases in size in a stair-step fashion to diameters of decreasing size. Specifically, FIG. 1 shows the diameter of inner conductor 26 decreasing from d1 at first end 12 to d2, d3, d4, and to d5 at second end 14, where inner conductor 26 contacts transmission line 18.

Microwave signal connector 10 further includes an outer conductor 30 that extends from first end 12 to second end 14 of the microwave signal connector. Outer conductor 30 is bisected by central axis 28 of microwave signal connector 10 such that outer conductor 30 is positioned with the same central axis as inner conductor 26, that is coaxially. Outer conductor 30 includes a first inner diameter D1 that extends from first end 12 partially but not completely through microwave signal connector 10. The inner diameter of outer conductor 30 decreases in size in a stair-step fashion to diameters of decreasing size. Specifically, FIG. 1 shows the diameter of outer conductor 30 decreasing from D1 at first end 12 to D2, D3, D4, and to D5 at second end 14. Optionally, outer conductor 30 includes securing portion 22.

The stair-step decrease in diameters of inner conductor 26 and outer conductor 30 are offset with respect to one another such that an offset K1 exists between the change in diameter from d1 to d2 of inner conductor 26 and the change in diameter from D1 to D2 in outer conductor 30. Similarly, offsets K2 and K3 are shown at the transitions from d2 to d3 and D2 to D3 as well as from d3 to d4 and D3 to D4, respectively.

Dielectric materials 34, 36, and 38 are disposed between inner conductor 26 and outer conductor 30. Dielectric materials 34, 36, and 38 are homogenous dielectric materials and include both air and plastics that maintain consistent dielectric properties and provide low attenuation of electromagnetic energy over large ranges of operating frequencies. In one common embodiment, dielectric materials 34 and 38 are air, and dielectric material 36 is a plastic material. Plastic material 36 includes thermoplastics such as polyethermide (also known as Ultem®), polyether ether ketone (PEEK), polychlorotrifluoroethylene (PCTFE) (also known as Kel-F®), and fluoropolymers such as polytetrafluoroethylene (also known as Teflon®). Dielectric materials 34, 36, and 38 are disposed between offsets K1, K2, and K3. Adjustments to a length or distance of offsets K1, K2, and K3 are made in order to adjust capacitance and inductance within the microwave signal connector 10 and to minimize reflections of the microwave signal being transmitted through the microwave signal connector. A dielectric constant of dielectric materials 34, 36, and 38 is adjusted or changed in order to adjust capacitance and inductance within the microwave signal connector 10 and to minimize reflections of the microwave signal being transmitted through the microwave signal connector. The governing equations used to minimize microwave signal reflections by adjusting the dielectric constants of dielectrics 34, 36, and 38 and by adjusting the offsets K1, K2, and K3 are well known in the art and are based on the use of homogenous or unitary dielectric materials disposed between inner conductor 26 and outer conductor 30.

Details relating to known means and methods of mechanical engagement for microwave signal connectors, omitted from the functional description made above in reference to the various features of FIG. 1, are now addressed. A primary objective for microwave signal connectors is to maintain the position and structural integrity of the inner conductor and dielectric material within the outer conductor when assembled to transmission lines and other devices. Current construction methods, as known in the prior art, use purely mechanical means for holding the microwave signal connector together. Known construction methods for mechanically holding the microwave signal connector together include construction using barbs and dimples, beads, and an epoxy rod for mechanical capture.

A known construction method for mechanically holding a microwave signal connector together includes the use of barbs and dimples. Barbs are used to capture an inner conductor within a plastic dielectric material by deforming or displacing the plastic to receive the inner conductor and then apply pressure to the inner conductor. Dimples are formed in the outer conductor that deform a portion of the outer conductor to capture the plastic dielectric material by extending the outer conductor into, and applying pressure on, the plastic dielectric material. While the barbs and dimples mechanically secure the inner conductor, the plastic dielectric, and the outer conductor to one another, the changes in geometry of the transmission line resulting from the deformation caused by the barbs and dimples undesirably cause reflections of microwave energy during transmission of a microwave signal.

Another known construction method for mechanically holding a microwave signal connector together includes the use of beads. A bead of a harder plastic material including thermoplastics such as polyethermide, PEEK, and PCTFE are used to capture the inner and outer conductors. Grooves are formed or machined into the outer and inner conductors to receive a portion of the bead. The bead can be pressed into the grooves, or alternatively, a subsection of one or more conductors can be screwed together with the bead. In either event, the conductors and bead are captured between the inner conductor and the outer conductor, thereby locking and holding the microwave signal connector together.

Another known construction method for mechanically holding a microwave signal connector together includes the use of an epoxy rod. The epoxy rod is made by forming or drilling holes completely through an outer conductor and completely through a plastic dielectric. A hole or groove and is formed or machined partially through an inner conductor to form a groove. The holes or openings in the outer conductor, dielectric, and inner conductor are aligned and a liquid epoxy is injected into the aligned openings and cured to form a solid rod. The epoxy rod mechanically captures or fixes the dielectric in place relative to the inner and outer conductors by being rigidly fit within the holes made through the outer conductor, dielectric, and inner conductor. Thus, the rod-like shape of the cured epoxy is used to mechanically secure together the components of the microwave signal connector.

SUMMARY

A need exists to provide a simpler more efficient design for microwave signal connectors. Accordingly, in one aspect, a microwave signal connector can comprise a first portion of an inner conductor comprising a first diameter. A second portion of the inner conductor comprises a second diameter less than the first diameter that is in contact with the first portion of the inner conductor. An outer conductor is disposed around the first portion of the inner conductor and the second portion of the inner conductor with a first inner diameter disposed over the first diameter and a second inner diameter disposed over the second diameter. A dielectric material is disposed between the second portion of the inner conductor and the outer conductor that extends along a length of the second portion of the inner conductor. An adhesive is attached to the dielectric material, the second portion of the inner conductor, and the outer conductor.

The microwave signal connector can further comprise a first end of the microwave connecter configured to connect with a first coaxial cable and a second end either configured to connect to a substrate or to a second coaxial cable. The length of the dielectric and a length of the adhesive can be based on a ratio between the first diameter and the second diameter. A first portion of the adhesive can be disposed along an interface between the second portion of the second inner conductor and the dielectric material, and a second portion of the adhesive can be disposed along an interface between the dielectric material and the first diameter of the outer conductor. A thickness of the adhesive and the dielectric material can comprise an impedance selected to reduce capacitance of the microwave connector and reduce reflection of a microwave signal traveling through the microwave connector along the first portion of the inner conductor and the second portion of the inner conductor. The adhesive can comprise a thickness in a range of about 12-500 micrometers.

In another aspect, a microwave signal connector that can comprise an inner conductor. An outer conductor is disposed around the inner conductor. A dielectric material is disposed between the inner conductor and the outer conductor and extends along a length of the inner conductor and the outer conductor. An adhesive is disposed between the inner conductor and the outer conductor and is attached to the dielectric material.

The microwave signal connector can further comprise the adhesive attaching the inner conductor to the dielectric material. The adhesive can attach the outer conductor to the dielectric material. A length of the adhesive can be configured to comprise an impedance selected to reduce capacitance of the microwave connector and reduce reflection of a microwave signal traveling through the microwave connector. The first inner diameter can be a diameter of approximately 2.92 millimeters and the second inner diameter can be a diameter of approximately 1.85 millimeters. The dielectric material and the adhesive can form a dielectric structure that is heterogeneous between the inner and outer conductor in a direction of an electric field line. The microwave signal connector can be made by forming the inner conductor with multiple steps that minimize microwave signal reflections within the microwave signal connector.

In yet another aspect, a method of making a microwave signal connector that can comprise providing a first portion of an inner conductor comprising a first diameter, providing a second portion of the inner conductor comprising a second diameter less than the first diameter contacting the first diameter, disposing an outer conductor around the first portion of the inner conductor and the second portion of the inner conductor, disposing a dielectric material between the second portion of the inner conductor and the outer conductor, the dielectric material extending along a length of the second portion of the inner conductor, and attaching an adhesive to the dielectric material between the second portion of the inner conductor and the outer conductor.

The method of making a microwave signal connector can further comprise forming the outer conductor comprising a first inner diameter disposed over the first diameter, and forming the outer conductor comprising a second inner diameter disposed over the second diameter, the second inner diameter being less than the first inner diameter. The method can further comprise forming a length of the adhesive attached to the second portion of the inner conductor to reduce reflection of a microwave signal traveling through the microwave connector. The method can further comprise forming at least a length of the dielectric material and the adhesive based on a ratio between the first diameter and the second diameter. The method can further comprise forming a first portion of the adhesive between the second portion of the inner conductor and the dielectric material, and forming a second portion of the adhesive between the dielectric material and the first diameter of the outer conductor. The method can further comprise forming a notch disposed between the inner conductor and the outer conductor, and disposing the adhesive within the notch. The method can further comprise coupling the inner conductor to the outer conductor with the adhesive and with a mechanical connection.

DETAILED DESCRIPTION

Embodiments in the disclosure present methods and systems to improve connectors and connections for transmission lines, which can be for used in the transmission of microwave signals.

In the following description, numerous specific details are set forth, such as specific configurations, compositions, and processes, in order to provide a thorough understanding of the disclosuer. In other instances, well-known processes and manufacturing techniques have not been described in particular detail in order to not unnecessarily obscure the disclosure. Furthermore, it is to be understood that the various embodiments shown in the FIGS. are illustrative representations and are not necessarily drawn to scale.

The terms "over," "between," and "on" as used herein refer to relative positions of one layer with respect to other layers. One layer deposited or disposed above, below, over, or under another layer may be directly in contact with the other layer or may have one or more intervening layers. One layer deposited or disposed between layers may be directly in contact with the layers or may have one or more intervening layers. A first layer "on" a second layer may be directly in contact with the second layer or may have one or more intervening layers.

Figure 1:
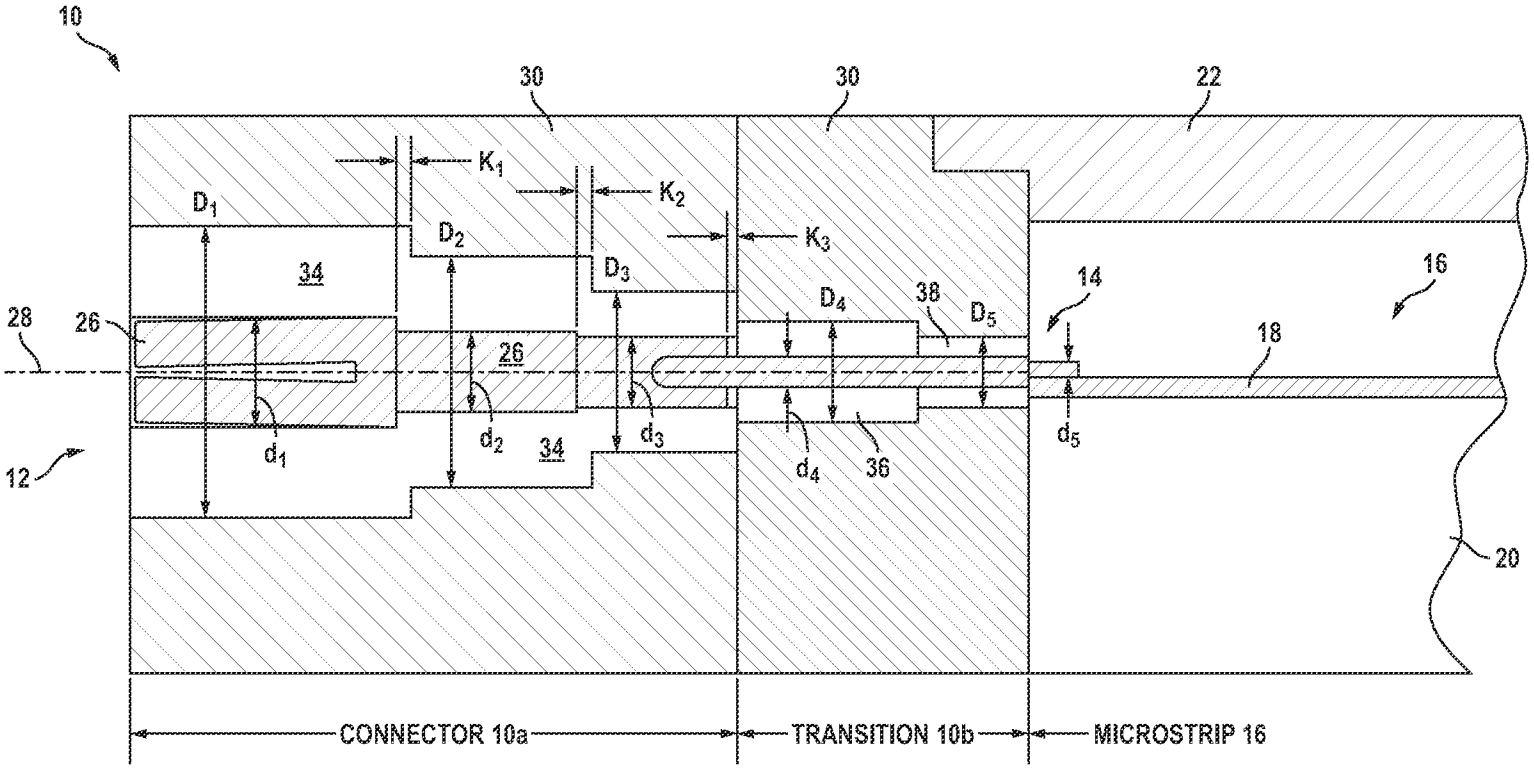
FIG. 1 (PRIOR ART)
FIG. 1 illustrates a cross-sectional view of a microwave signal connector as known in the prior art.
Figure 2A:
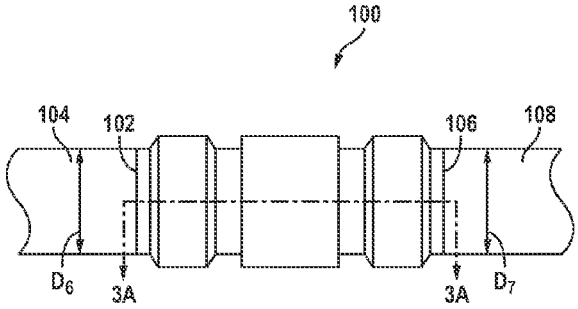
FIGS. 2A-2B illustrate microwave signal connectors attached to transmission lines such as coaxial cables and a microstrip.

FIG. 2A shows a profile view of a microwave signal connector 100 according to the disclosure, which includes an attachment point or end 102 coupled to a coaxial cable or transmission line 104. Coaxial cable 104 includes an outer or overall diameter D6. Microwave signal connector 100 also includes an attachment point or end 106 coupled to a transmission line or coaxial cable 108. Coaxial cable 108 includes an outer or overall diameter D7 that is less than diameter D6 of coaxial cable 104. Alternatively, diameter D7 is greater than or equal to diameter D6 such that microwave signal connector 100 mechanically couples and electrically connects two or more transmission lines of different sizes. Coaxial cables 104 and 108, in addition to including different diameters, can also include different cross sectional areas. Thus, while coaxial cables 104 and 108 typically include circular cross sectional areas, transmission lines also include cross-sectional areas that are oval, elliptical, square, or of any other shape.

While microwave signal connector 100 is shown with two attachment points, the microwave signal connector can include any number of attachment points for connecting to transmission lines such as coaxial cables, microstrips, substrates, or other devices. More specifically, microwave signal connector 100 can include a first number of attachment points on a first side or portion of the microwave signal connector and a second number of attachment points on a second side or portion of the microwave signal connector. Attachment points 102 and 106 of microwave signal connector 100 can be in-line with each other and aligned at a 180 degree angle with respect to each other. Alternatively, attachment points 102 and 106 can be parallel but offset with respect to each other. In an exemplary embodiment, attachment points 102 and 106 are not directly in-line or offset with respect to each other, but are instead angled such that a desirable angle, such as a 90 degree angle, a 45 degree angle, or any other angle, exists between attachment points 102, 106, or any additional attachment points.

Figure 2B:
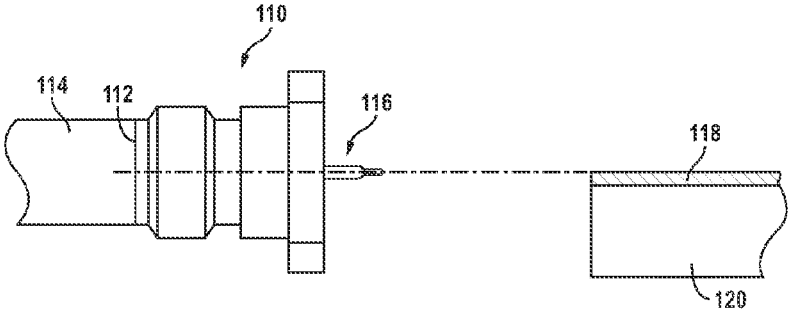

FIG. 2B shows a profile view of a microwave signal connector 110, similar to the microwave signal connector 100 of FIG. 2A. Microwave signal connector 110 includes an attachment point or end 112 coupled to a coaxial cable or transmission line 114, which are similar to end 102 and coaxial cable 104, respectively. Microwave signal connector 110 also includes an attachment point or end 116 including a pin or conductive material. Attachment point 116 is configured to attach to microstrip or transmission line 118 on substrate 120. In an exemplary embodiment, microwave signal connector 110 mechanically couples and electrically connects two or more transmission lines or coaxial cables of the same or different sizes. In order for microwave signal connector 110 to both mechanically secure to transmission lines of different sizes and also provide acceptable performance and limited reflection of microwave signals transmitted through the microwave signal connector, a number of features must be controlled within the microwave signal connector, which is discussed in greater detail below in reference to FIGS. 3A-5.

While microwave signal connector 110 is shown with two attachment points, the microwave signal connector can include any number of attachment points for connecting to transmission lines such as coaxial cables, microstrips, substrates, or other devices. More specifically, microwave signal connector 110 can include a first number of attachment points on a first side or portion of the microwave signal connector and a second number of attachment points on a second side or portion of the microwave signal connector. Attachment points 112 and 116 of microwave signal connector 110 can be in-line with each other and aligned at a 180 degree angle with respect to each other. Alternatively, attachment points 112 and 116 can be parallel but offset with respect to each other. In an exemplary embodiment, attachment points 112 and 116 are not directly in-line or offset with respect to each other, but are instead angled such that a desirable angle, such as a 90 degree angle, a 45 degree angle, or any other angle, exists between attachment points 112, 116, or any additional attachment points.

Figure 3A:
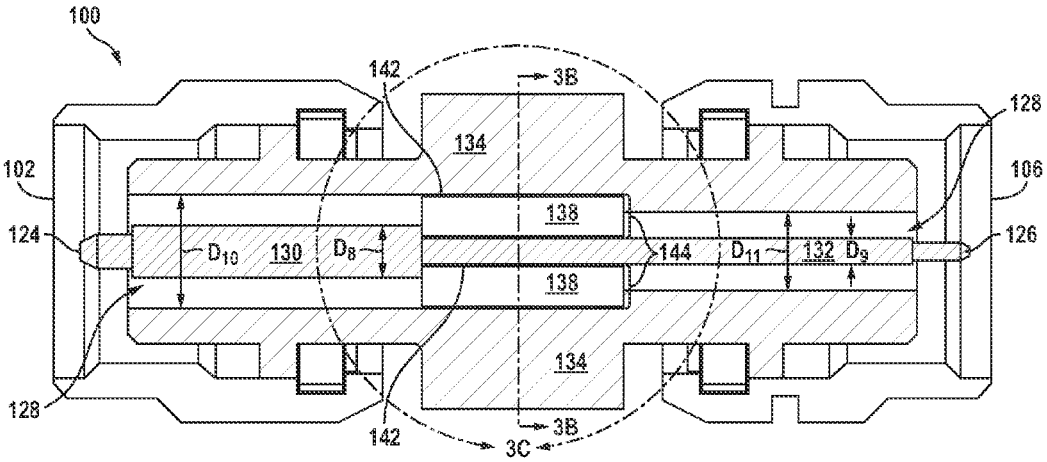
FIGS. 3A-3C illustrate various views of a microwave signal connector comprising an adhesive.

FIG. 3A shows an enlarged cross sectional view of microwave signal connector 100 from FIG. 2A without the attachment of coaxial cables 104 and 108. While attachment points 102 and 106 include pins 124 and 126, respectively, microwave signal connector 100 can also include slots for receiving pins or any other type of connector that couples inner conductor 128 within microwave signal connector 100 to transmission lines within coaxial cables 104 and 108.

Inner conductor 128 is sized to match a size of inner conductors disposed within coaxial cables 104 and 108. FIG. 3A shows inner conductor 128 formed with a first inner conductor or inner portion 130 including a first diameter D8 and a second inner conductor or portion 132 including a second diameter D9 that contacts the first portion. In an exemplary embodiment, diameter D9 is less than diameter D8. Alternatively, diameter D9 can be greater than or equal to diameter D8. A step is created where an end of first portion 130 contacts an end of second portion 132 of inner conductor 128. A size of the step between first and second portions 130 and 132 of inner conductor 128 is determined in part by a difference in size or diameter of the inner conductors in coaxial cables 104 and 108. While FIG. 3A shows inner conductor 128 with two portions with two different diameters, any number of diameters and steps can be formed according to the design and function of microwave signal connector 100. Inner conductor 128 is one or more layers of conductive material including copper, silver, steel, or other suitable material that allows for the transmission of an electrical signal between ends 102 and 106.

FIG. 3A also shows outer conductor 134 disposed over first and second portions 130 and 132 of inner conductor 128 with a first inner diameter D10 disposed over or around first diameter D8 and a second inner diameter D11 disposed over or around second diameter D9. Outer conductor 134 is disposed around inner conductor 128 and shares a common axis or is coaxial with inner conductor 128. In an exemplary embodiment, diameter D11 is less than diameter D10. Alternatively, diameter D11 can be greater than or equal to diameter D10. A step is created at a location where diameters D10 and D11 meet. A size of the step between D10 and D11 is determined in part by a difference in size of coaxial cables 104 and 108. A size of coaxial cables 104 and 108 is commonly referenced by an inner diameter of the outer conductor, such as by the dimensions of D10 and D11. As a non-limiting example, D10 can be a distance of about 2.92 millimeters (mm) or other suitable distance, and D11 is a distance of about 1.85 mm or other suitable distance. While FIG. 3A shows outer conductor 134 includes two different diameters, D10 and D11, any number of diameters and steps can be formed according to the design and function of microwave signal connector 100. Outer conductor 134 is one or more layers of conductive material including copper, silver, steel, or other suitable material. Outer conductor 134 provides shielding or protection of a transmitted signal through microwave signal connector 100 with respect to external interference including electromagnetic interference.

A dielectric material 138 is disposed between inner conductor 128 and outer conductor 134. Dielectric material 138 also extends along a length of inner conductor 128. Dielectric material 138 includes thermoplastics such as polyethermide, PEEK, PCTFE, fluoropolymers such as polytetrafluoroethylene, and other suitable materials that can, as a non-limiting example, include a dielectric coefficient in a range of about 1.0-4.0, or in a range of about 2.4-2.6. Properties of dielectric 138 are selected to control some electrical properties of the cable. Dielectric 138 prevents outer conductor 134 from contacting inner conductor 128 and maintains a spacing or offset between the inner and outer conductors through which microwave signals can be transmitted.

Figure 3B:
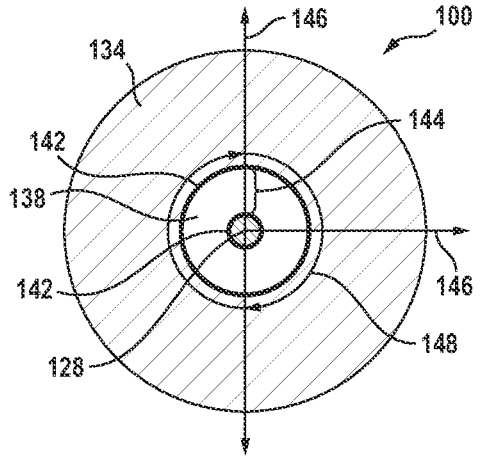

FIG. 3A also shows an adhesive 142 attached to inner conductor 128, outer conductor 134, and dielectric material 138 within microwave signal connector 100, which is discussed in greater detail below with respect to FIG. 3C. FIG. 3B is an alternate cross-sectional view that is transverse to the view shown in FIG. 3A and is taken along section line 3B-3B shown in FIG. 3A. FIG. 3B shows inner conductor 128, adhesive 142, dielectric 138, and outer conductor 134 arranged as concentric layers disposed one around the other. Thus, portion 144 of microwave signal connector 100 disposed between inner conductive layer 128 and outer conductive layer 134 includes portions of both dielectric material 138 and adhesive material 142 such that the material disposed between the inner and outer conductive layers is heterogeneous with respect to a direction of the electric field lines 146 between the inner and outer conductors in the signal transmission path. In other words, a line that is normal to, and extends between, inner conductor 128 and outer conductor 134, is also normal to magnetic field lines such as magnetic field line 148 and passes through heterogeneous or non-homogenous material within microwave signal connector 100.

Forming microwave signal connector 100 comprising heterogeneous portion 144 is significant because microwave signals are transmitted in the space between inner conductor 128 and outer conductor 134. Furthermore, any new material in the transmission line path or portion 144 can change the electrical properties of the transmission path. If the changes in the electrical properties are not properly accounted for, portions of the signal transmitted through the transmission path will be reflected, thereby degrading signal quality. As known in the prior art, there is a family of materials commonly used in microwave transmission lines that includes air, fluoropolymers such as polytetrafluoroethylene, thermoplastics such as polyethermide, PEEK, and PCTFE. Adhesives are not part of this family of commonly used materials and have not been accepted as forming part of a heterogeneous structure disposed between inner and outer conductors within microwave transmission lines, as described above. However, as illustrated in FIG. 3B, in a particular embodiment, adhesive 142 can include an area that is equal to or less than about five percent (5%) of a total cross-sectional area of microwave signal connector 100. In another exemplary embodiment, adhesive 142 can include an area that is equal to or less than about one percent (1%) of a total cross-sectional area of microwave signal connector 100, and in other embodiments less than about two percent (2%). Given this enabling disclosure, a person having ordinary skill in the art will know how to adjust an area of adhesive 142, for example as a percentage of total cross-sectional area, to achieve adequate bonding while maintaining acceptable levels of electrical performance.

Previously in the art, adhesives have been used in signal line connectors outside the outer conductor such that the adhesives are not disposed between the inner and outer conductors as part of a group of heterogeneous materials disposed between the inner and outer conductors. The previously known methods of using barbs and dimples, beads, and epoxy rods do not use adhesives disposed between the inner and outer conductors to form a part of a heterogeneous dielectric structure with respect to electric field lines within the signal path. More specifically, epoxy rods that have been used to mechanically secure components of a microwave signal connector are not used as adhesives. Furthermore, even if epoxy rods used for mechanical connection were to be considered adhesives, the epoxy rods are not disposed at an interface between a dielectric material and the inner conductor and at an interface between a dielectric material and the outer conductor.

Additionally, an epoxy shaped rod as know in the art includes a homogeneous and not a heterogeneous cross-section taken through the epoxy shaped rod in a direction of the electric field lines between the inner and outer conductors in the signal transmission path. In other words, any normal line taken between the inner conductor and outer conductor that is normal to the magnetic field lines passes through only a homogenous material, such as the epoxy rod, between the inner and outer conductors. Significantly, a cross section taken in the direction of the electric field of the microwave connector and through an epoxy shaped rod as known in the prior art does not produce the heterogeneous cross-section as shown in FIGS. 3A-3C, which is created by disposing an adhesive between the dielectric layer and the inner conductor or between the dielectric layer and the outer conductor. As such, the epoxy rod structure disturbs signal frequency through known fringe effects because magnetic field lines, similar to magnetic field line 148, pass through more than one material at a time along an entire distance of the epoxy rod structure extending between the inner conductor and outer conductor.

Figure 3C:
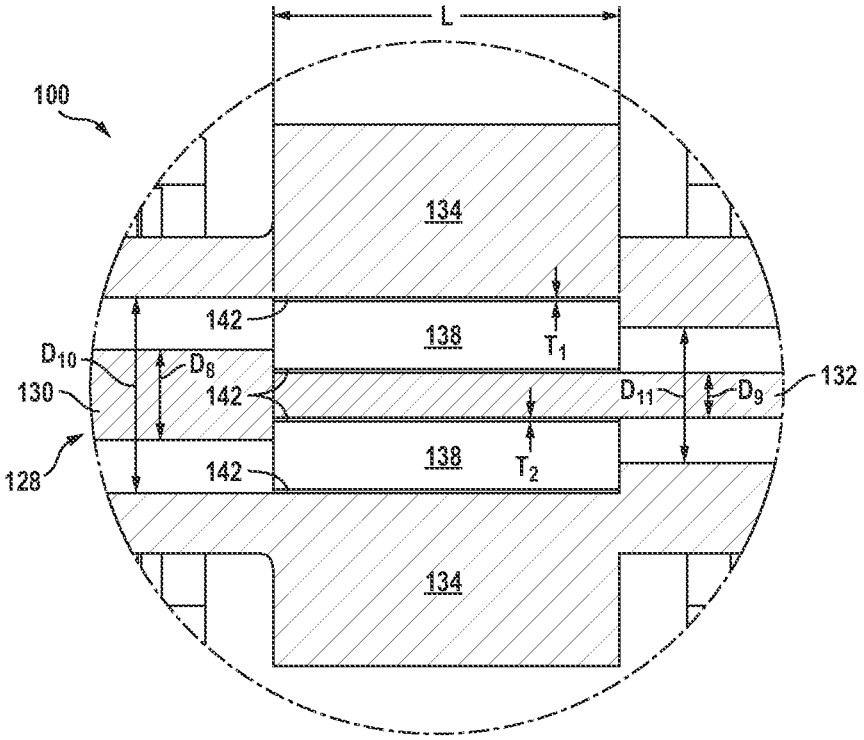

To the contrary, the structure described in relation to FIGS. 3A-3C does not disturb signal frequency through known fringe effects along an entire distance extending between inner conductor 128 and outer conductor 134 because magnetic field lines, such as magnetic field line 148, substantially pass through only one material at a time, such as dielectric material 134 or adhesive 142. Magnetic field lines, such as magnetic field line 148, may only substantially pass through one material at a time because a roughness or texture of inner conductor 128 and outer conductor 134 can create a boundary condition in which high and low points of the inner and outer conductors create small areas of, for example less than about 5%, 2%, or 1% of the total cross-sectional area of microwave signal connector 100, in which magnetic field lines could pass through both adhesive 142 and the inner or outer conductors. However, as noted above, magnetic filed lines do not pass through more than one material at a time, or through a heterogeneous group of materials, along an entire distance extending between the inner conductor and outer conductor as with the epoxy rod structure.

In some embodiments, inner conductor 128 and outer conductor 134 of microwave signal connector 100 can be coupled by both a mechanical connection and by adhesive 142. Alternatively, microwave signal connector 100 can be coupled by adhesive 142 without a mechanical connection.

FIG. 3C shows an enlarged view of a portion of microwave signal connector 100 as indicated by line 3C in FIG. 3A. FIG. 3C shows additional detail of adhesive 142 attached to inner conductor 128 including diameter D10, outer conductor 134, and dielectric material 138 within microwave signal connector 100. A first portion of adhesive 142 is disposed along an interface between outer conductor 134 and dielectric material 138. The first portion of adhesive 142 includes a thickness T1. A second portion of adhesive 142 is disposed along an interface between dielectric material 138 and a portion of inner conductor 132. The second portion of adhesive 142 includes a thickness T2. In an exemplary embodiment, a thickness T1 is equal to thickness T2. Alternatively thickness T1 is greater than or less than thickness T2. As a non-limiting example, thicknesses T1 and T2 of adhesive 142 can comprise a thickness in a range of about 12-500 micrometers (μm). Thicknesses T1 and T2 of adhesive 142 as well as dielectric material 138 comprise impedances selected to reduce capacitance of the microwave signal connector 100 and reduce reflection of a microwave signal traveling through the microwave signal connector along inner conductor 128. For embodiments in which a dielectric constant of the adhesive 142 is closer to a dielectric constant of dielectric material 138, a viscosity and or thickness of the adhesive can be increased without negatively effecting electrical performance of microwave signal connector 100.

Similarly, a length of adhesive 142 is configured to comprise an impedance that is selected to reduce capacitance of microwave signal connector 100 and reduce reflection of a microwave signal traveling through the microwave connector. A length of dielectric 138 and a length of adhesive 142 are based on a ratio between a diameter D8 of portion 130 of inner conductor 128 and diameter D9 of portion 132 of inner conductor 128. In a particular exemplary embodiment, the length of dielectric 138 and the length of adhesive 142 are equal to one another and thus are both equal to a length L in a range of about 500-6,400 μm. Alternatively, a length of dielectric 138 is greater than or less than a length of adhesive 142.

FIG. 3C further shows forming inner conductor 128 with a single step between diameter D8 of first portion 130 and diameter D9 of second portion 132. A ratio between at least diameter D8 and diameter D9 is configured to reduce microwave reflections. Inner conductor 128 can also be formed with additional portions that produce multiple steps or changes in diameter along a length of inner conductor 132. A number of steps and a size of the steps formed along inner conductor 128 are configured to reduce or minimize microwave signal reflections within microwave signal connector 100 by controlling for various capacitances and inductances within the microwave signal connector caused by material properties such as content and geometry of dielectric 138 and adhesive 142. By reducing microwave signal reflections, degradation of signal strength and quality is reduced as a signal passes through microwave signal connector 100.

In FIG. 3C, outer conductor 134 is formed comprising first inner diameter D10 disposed over or around diameter D8 and a portion of diameter D9. Second inner diameter D11 is disposed over or around diameter D9. In an exemplary embodiment, second inner diameter D11 is less than first inner diameter D10. In another exemplary embodiment, first inner diameter D10 and second inner diameter D11 are configured to accommodate connections between ends of microwave signal connector 100 and other devices. In yet another exemplary embodiment, inner diameters D10 and D11 of outer conductor 134 are sized to attach to standard transmission lines, and as such comprise diameters of approximately 2.92 mm and 1.85 mm, respectively. A ratio between diameters D10 and D11 is also configured, at least in part, to reduce microwave reflections.

When properly accounted for, adhesive 142 can be disposed in the transmission line path between inner conductor 128 and outer conductor 134 without causing excessive reflections. Adhesive 142 is applied in a liquid, paste, or gel form as microwave signal connector 100 is assembled. As the adhesive cures, a chemical change in adhesive 142 creates both a solid structure and a physical bond between the materials where the adhesive is applied, for example, between dielectric 138, inner conductor 128, and outer conductor 134. Accordingly, adhesive 142 provides a chemical solution that solves many of the mechanical problems inherent with mechanically connected microwave connectors by providing a simpler structure.

Figure 4A:
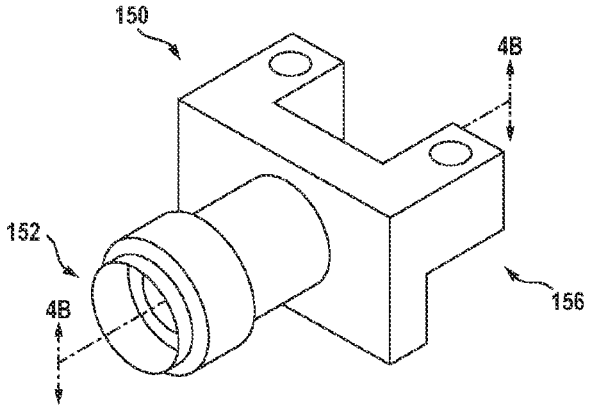
FIGS. 4A and 4B illustrate various views of another exemplary embodiment of a microwave signal connector comprising an adhesive.

FIG. 4A shows a perspective view of a microwave signal connector 150, similar to microwave signal connector 110 of FIG. 2B. Microwave signal connector 150 includes an attachment point or end 152 similar to attachment point or end 112 and is configured to be coupled to a coaxial cable or transmission line. Microwave signal connector 150 also includes an attachment point or end 156 similar to attachment point or end 116. Attachment point 156 includes a pin or conductive material, and is configured to attach to a microstrip or transmission line and substrate. In an exemplary embodiment, microwave signal connector 150 mechanically couples and electrically connects to two or more transmission lines or coaxial cables of different sizes. In order for microwave signal connector 150 to both mechanically secure to the transmission lines of different sizes and also provide acceptable performance and limited reflection of microwave signals transmitted through the microwave signal connector, a number of features must be controlled within the microwave signal connector, which are discussed in greater detail below in reference to FIG. 4B.

While microwave signal connector 150 is shown with two attachment points, the microwave signal connector can include any number of attachment points for connecting to transmission lines such as coaxial cables, microstrips, substrates, or other devices. More specifically, microwave signal connector 150 can include a first number of attachment points on a first side or portion of the microwave signal connector and a second number of attachment points on a second side or portion of the microwave signal connector. Attachment points 152 and 156 of microwave signal connector 150 can be in-line with each other and aligned at a 180 degree angle with respect to each other. Alternatively, attachment points 152 and 156 can be parallel but offset with respect to each other. In an exemplary embodiment, attachment points 152 and 156 are not directly in-line or offset with respect to each other, but are instead angled such that a desirable angle, such as a 90 degree angle, a 45 degree angle, or any other angle, exists between attachment points 152, 156, or any additional attachment points.

Figure 4B:
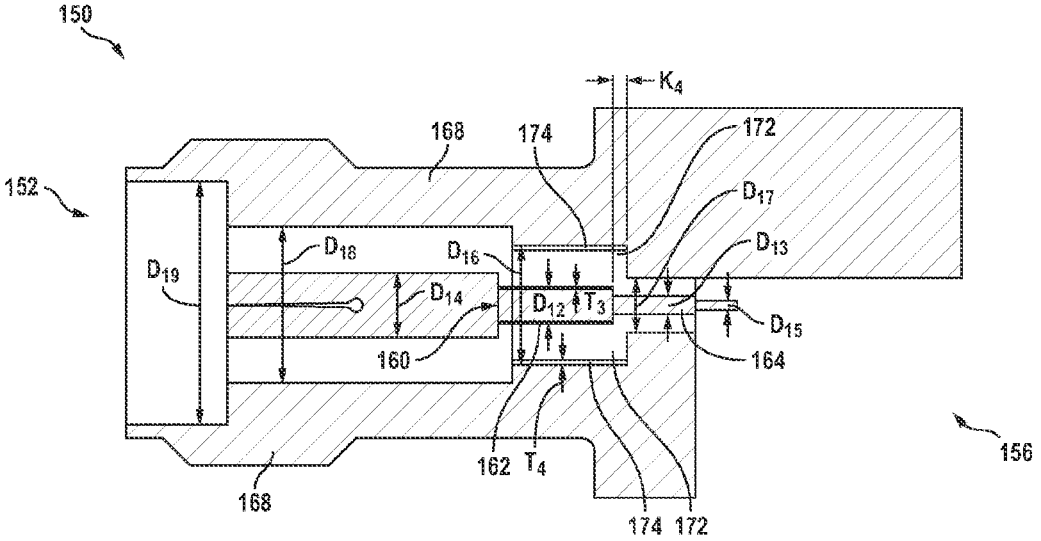

FIG. 4B shows a cross sectional view of microwave signal connector 150 taken along line 4B-4B shown in FIG. 4A. FIG. 4B shows inner conductor 160 formed with a first inner conductor or inner portion 162 including a first diameter D12 and a second inner conductor or portion 164 including a second diameter D13 that contacts the first portion. In an exemplary embodiment, diameter D13 is less than diameter D12. Alternatively, diameter D13 can be greater than or equal to diameter D12. A step is created where an end of first portion 162 contacts an end of second portion 164 of the inner conductor. A size of the step between first and second portions 162 and 164 of inner conductor 160 is determined in part by a difference in size or diameter of the devices or transmission lines to which microwave signal connector is coupled. While FIG. 4B shows inner conductor 160 with two portions with two different diameters, that is D12 and D13, any number of diameters and steps can be formed along inner conductor 160, including for example diameters D14 and D15, according to the design and function of microwave signal connector 150. Inner conductor 160 is one or more layers of conductive material including copper, silver, steel, or other suitable material that allows for the transmission of an electrical signal from first end 152 to second end 156. Changes in diameter of inner conductor 160 along a length of signal microwave connector 150, including a number of steps and a ratio of diameters at each step, are configured to reduce microwave reflections by controlling for various capacitances and inductances within the microwave signal connector caused by material properties such as content and geometry of dielectric material 172 and adhesive 174. By reducing microwave signal reflections, degradation of signal strength and signal quality is reduced as a signal passes through microwave signal connector 150.

FIG. 4B also shows outer conductor 168 disposed over first portion 162 and second portion 164 of inner conductor 160 with a first inner diameter D16 disposed over first diameter D12 and a second inner diameter D17 disposed over second diameter D13. Outer conductor 168 is disposed around inner conductor 160 and shares a common axis or is coaxial with inner conductor 160. In an exemplary embodiment, diameter D17 is less than diameter D16. Alternatively, diameter D17 can be greater than or equal to diameter D16. A step is created at a location where diameters D16 and D17 meet. A size of the step between D16 and D17 is determined in part by a difference in size of the transmission lines connected to ends 152 and 156, and is configured, at least in part, to reduce microwave reflections. FIG. 4B shows outer conductor 168 includes diameters D16 and D17 as well as diameters D18 and D19. However, outer conductor 168 can include any number of diameters and steps, which are formed according to the design and function of the microwave signal connector. Outer conductor 168 is one or more layers of conductive material including copper, silver, steel, or other suitable material that allows for the transmission of an electrical signal from first end 152 to second end 156. Outer conductor 168 provides shielding or protection of a transmitted signal through microwave signal connector 150 with respect to external interference including electromagnetic interference.

A dielectric material 172 is disposed between inner conductor 160 and outer conductor 168. Dielectric material 172 also extends along a length of inner conductor 160. Dielectric material 172 includes thermoplastics such as polyethermide, PEEK, PCTFE, fluoropolymers such as polytetrafluoroethylene, and other suitable materials. Properties of dielectric material 172 are selected to control some electrical properties of the cable. As a non-limiting example, a dielectric coefficient of dielectric material 172 can be in a range of about 1.0-4.0, and can also be in a range of about 2.4-2.6. Dielectric 172 prevents outer conductor 168 from contacting inner conductor 160 and maintains a spacing or offset between the inner and outer conductors through which microwave signals can be transmitted.

FIG. 4B also shows an adhesive 174 attached to inner conductor 160, outer conductor 168, and dielectric material 172 within microwave signal connector 150. FIG. 4B shows inner conductor 160, adhesive 174, dielectric 172, and outer conductor 168 arranged as concentric layers disposed one around the other. Thus, adhesive 174 and dielectric 172 are disposed between inner conductive layer 160 and outer conductive layer 168 such that the material disposed between the inner and outer conductive layers is heterogeneous with respect to a cross section taken in a direction of electric field lines. Stated another way, the material disposed between the inner conductive layer 160 and outer conductive layer 168 is substantially homogeneous with respect to magnetic field lines within microwave signal connector 150. The formation of microwave signal connector 150 comprising a heterogeneous portion between inner conductor 160 and outer conductor 168 in a direction of electric field lines is significant because, similar to the discussion above with respect to FIGS. 3A-3C, microwave signals are transmitted in the space between inner conductor 160 and outer conductor 168. Furthermore, any new material in the transmission line path changes the electrical properties of the transmission path. If the changes in electrical properties are not properly accounted for, portions of the signal transmitted through the transmission path will be reflected, thereby degrading signal quality. As known in the prior art, there is a family of materials commonly used in microwave transmission lines that includes air, fluoropolymers such as polytetrafluoroethylene, thermoplastics such as polyethermide, PEEK, and PCTFE. Adhesives are not part of this family of commonly used materials and have not been accepted as forming part of a heterogeneous structure disposed between inner and outer conductors within microwave transmission lines, as described above.

However, as shown in FIG. 4B, a first portion of adhesive 174 is disposed along an interface between a first portion of inner conductor 162 and dielectric material 172. The first portion of adhesive 174 includes a thickness T3. A second portion of adhesive 174 is disposed along an interface between dielectric material 172 and a portion of outer conductor 168 including diameter D16. The second portion of adhesive 174 includes at least a thickness T4. In an exemplary embodiment, second portion of adhesive 174 can also include an additional thickness greater than thickness T4 that is disposed in a ring, notch, grooves, indentation, or other suitable structure that provides for additional adhesive to be contained between inner conductor 160 and outer conductor 168 when forming microwave signal connector 150. In another embodiment, thickness T3 is equal to thickness T4. Alternatively, thickness T3 is greater than or less than thickness T4. As a non-limiting example, thicknesses T3 and T4 can comprise thicknesses in a range of about 12-500 μm or in a range of about 355-405 μm. Thicknesses T3 and T4 of adhesive 174 as well as dielectric material 172 comprise impedances selected to reduce capacitance of the microwave signal connector 150 and reduce reflection of a microwave signal traveling through the microwave connector in a direction of inner conductor 160.

Similarly, a length of adhesive 174 is configured to comprise an impedance that is selected to reduce capacitance of microwave signal connector 150 and reduce reflection of a microwave signal traveling through the microwave connector. Furthermore, length K4 of dielectric 172 is also configured to reduce capacitance of microwave signal connector 150 and reduce reflection of a microwave signal traveling through the microwave connector. Length K4 of dielectric 172 extends from the step in inner conductor 160 between D12 and D13 to the step in outer conductor 168 between D16 and D17. Dimensions including a length of dielectric 172 as well as dimensions including a length of adhesive 174 are based at least in part on a ratio between a diameter D12 of portion 162 of inner conductor 160 and diameter D13 of portion 164 of inner conductor 160. In an exemplary embodiment, the length of dielectric 172 and the length of adhesive 174 are equal to one another. Alternatively, a length of dielectric 172 is greater than or less than a length of adhesive 174.

When properly accounted for, adhesive 174 can be disposed in the transmission line path between inner conductor 160 and outer conductor 168 without causing excessive reflections. Adhesive 174 is applied in a liquid, gel, or paste form and then microwave signal connector 150 is assembled. As the adhesive cures, a chemical change in adhesive 174 creates both a solid structure and a physical bond between the materials where the adhesive is applied, for example, between dielectric 172, inner conductor 160, and outer conductor 168. Accordingly, adhesive 174 provides a chemical solution that solves many of the mechanical problems inherent with mechanically connected microwave connectors by providing a simpler structure that does not interfere with electrical performance.

Figure 5:
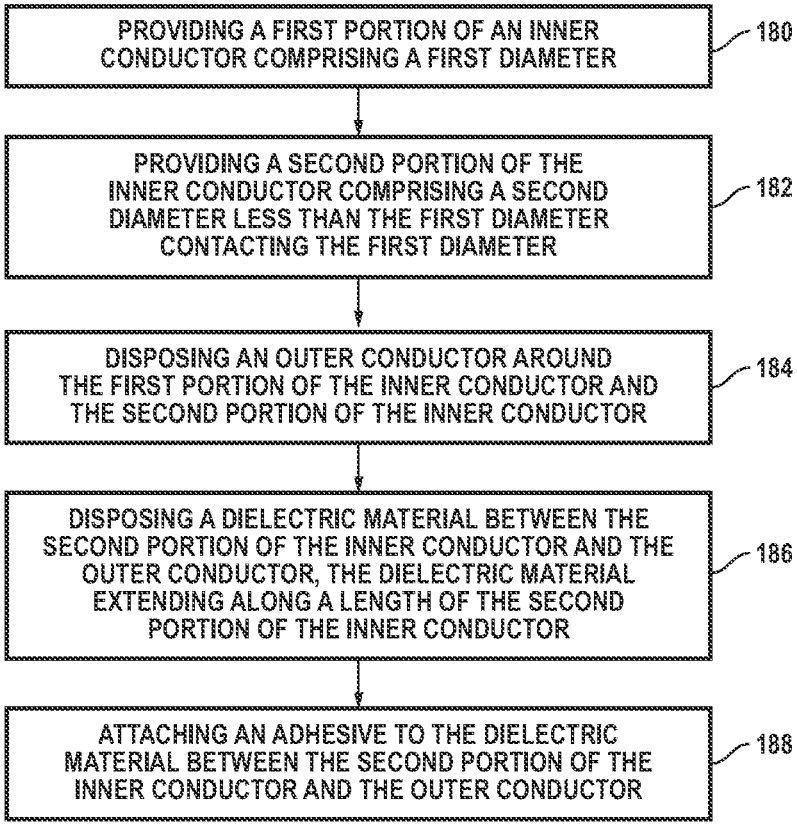
FIG. 5 illustrates a method of forming a microwave signal connector with an adhesive.

FIG. 5 is a flow diagram that shows a method of making or manufacturing a microwave signal connector that can comprise the steps of providing a first portion of an inner conductor comprising a first diameter (step 180), providing a second portion of the inner conductor comprising a second diameter less than the first diameter contacting the first diameter (step 182), disposing an outer conductor around the first portion of the inner conductor and the second portion of the inner conductor (step 184), disposing a dielectric material between the second portion of the inner conductor and the outer conductor, the dielectric material extending along a length of the second portion of the inner conductor (step 186), and attaching an adhesive to the dielectric material between the second portion of the inner conductor and the outer conductor (step 188).

The method of making the microwave signal connector further comprises forming a length of the adhesive attached to the second portion of the inner conductor comprising an impedance selected to reduce capacitance of the microwave connector and reduce reflection of a microwave signal traveling through the microwave connector in a direction of the first portion of the inner conductor and a second portion of the inner conductor. The method also comprises forming the inner conductor with multiple steps that minimize microwave signal reflections within the microwave signal connector. At least a length of the dielectric and a length of the adhesive are formed based on a ratio between the first diameter and the second diameter. A first portion of the adhesive is formed between the second portion of the inner conductor and the dielectric material while a second portion of the adhesive is formed between the dielectric material and the first diameter of the outer conductor. Thus, by predicting the electrical behavior of dielectric structures comprising adhesives that are homogeneous with respect to electric field lines and substantially heterogeneous with respect to magnetic field lines within microwave signal transmission paths, an adhesive can be used for mechanically attaching a microwave signal connector without negatively affecting electrical performance of the microwave signal connector.

In the foregoing specification, various embodiments have been described. It will, however, be evident that various modifications and changes may be made thereto without departing from the broader spirit and scope set forth in the appended claims. The specification and drawings are, accordingly, to be regarded in an illustrative sense rather than a restrictive sense.

What is claimed is:

1. A microwave signal connector, comprising:

a first portion of an inner conductor comprising a first diameter;

a second portion of the inner conductor comprising a second diameter less than the first diameter and in contact with the first portion of the inner conductor;

an outer conductor disposed around the first portion of the inner conductor and the second portion of the inner conductor with a first inner diameter disposed over the first portion and a second inner diameter disposed over the second portion;

a dielectric material disposed between the second portion of the inner conductor and the outer conductor that extends along a length of the second portion of the inner conductor; and an adhesive attached to the dielectric material, the second portion of the inner conductor, and the outer conductor, wherein the adhesive comprises a thickness in a range of about 12-500 micrometers.

2. The microwave signal connector of claim 1, wherein a first end of the microwave connector is configured to connect with a first coaxial cable and a second end is either configured to connect to a substrate or to a second coaxial cable.

3. The microwave signal connector of claim 1, wherein a length of the dielectric material and a length of the adhesive are based on a ratio between the first diameter and the second diameter.

4. The microwave signal connector of claim 1, further including:

a first portion of the adhesive disposed along an interface between the second portion of the inner conductor and the dielectric material; and a second portion of the adhesive disposed along an interface between the dielectric material and the first inner diameter of the outer conductor.

5. The microwave signal connector of claim 1, wherein the thickness of the adhesive and a thickness the dielectric material comprise an impedance selected to reduce capacitance of the microwave connector and reduce reflection of a microwave signal traveling through the microwave connector along the first portion of the inner conductor and the second portion of the inner conductor.

6. The microwave signal connector of claim 1, further comprising:

a notch disposed between the inner conductor and the outer conductor, wherein the adhesive is disposed within the notch.

7. A microwave signal connector, comprising:

an inner conductor;

an outer conductor disposed around the inner conductor;

a dielectric material disposed between the inner conductor and the outer conductor that extends along a length of the inner conductor and the outer conductor;

an adhesive disposed between the inner conductor and the outer conductor and attached to the dielectric material; and a length of the adhesive configured to comprise an impedance selected to reduce capacitance of the microwave connector and reduce reflection of a microwave signal traveling through the microwave connector.

8. The microwave signal connector of claim 7, wherein the adhesive attaches the inner conductor to the dielectric material.

9. The microwave signal connector of claim 7, wherein the adhesive attaches the outer conductor to the dielectric material.

10. The microwave signal connector of claim 7, further comprising:

a notch disposed between the inner conductor and the outer conductor, wherein the adhesive is disposed within the notch.

11. The microwave signal connector of claim 7, wherein a first inner diameter of the outer conductor comprises a diameter of approximately 2.92 millimeters and a second inner diameter of the outer conductor comprises a diameter of approximately 1.85 millimeters.

12. The microwave signal connector of claim 7, wherein the dielectric material and the adhesive form a dielectric structure that is heterogeneous between the inner and outer conductor in a direction of an electric field line.

13. A method of making the microwave signal connector of claim 7, comprising forming the inner conductor with multiple steps that minimize the microwave signal reflections within the microwave signal connector.

14. A method of making a microwave signal connector, comprising:

providing a first portion of an inner conductor comprising a first diameter;

providing a second portion of the inner conductor comprising a second diameter less than the first diameter contacting the first diameter;

disposing an outer conductor around the first portion of the inner conductor and the second portion of the inner conductor;

disposing a dielectric material between the second portion of the inner conductor and the outer conductor, the dielectric material extending along a length of the second portion of the inner conductor;

attaching an adhesive to a surface of the dielectric material between the second portion of the inner conductor and the outer conductor; and selecting at least one of a length of the dielectric material and a length of the adhesive based on a ratio between the first diameter and the second diameter.

15. The method of claim 14, further comprising:

forming the outer conductor comprising a first inner diameter disposed over the first portion; and forming the outer conductor comprising a second inner diameter disposed over the second portion, the second inner diameter being less than the first inner diameter.

16. The method of claim 14, further comprising forming the length of the adhesive attached to the second portion of the inner conductor to reduce reflection of a microwave signal traveling through the microwave connector.

17. The method of claim 14, further comprising coupling the inner conductor to the outer conductor with the adhesive, the dielectric material and with a mechanical connection.

18. The method of claim 14, further comprising:

forming a first portion of the adhesive between the second portion of the inner conductor and the dielectric material; and forming a second portion of the adhesive between the dielectric material and the outer conductor.

19. The method of claim 14, further comprising:

forming a notch disposed between the inner conductor and the outer conductor; and disposing the adhesive within the notch.

* * * * *